US008379901B2

(12) United States Patent
Mishra et al.

(10) Patent No.: US 8,379,901 B2
(45) Date of Patent: Feb. 19, 2013

(54) SOUND ENHANCEMENT SYSTEM

(75) Inventors: Rajeev Mishra, Manhattan Beach, CA (US); Maurice N. Leacock, Torrance, CA (US); Matthew R. Ford, Laguna Beach, CA (US)

(73) Assignee: Seiko Epson Corporation, Tokyo (JP)

( * ) Notice: Subject to any disclaimer, the term of this patent is extended or adjusted under 35 U.S.C. 154(b) by 428 days.

(21) Appl. No.: 12/703,507

(22) Filed: Feb. 10, 2010

(65) Prior Publication Data

US 2010/0316245 A1 Dec. 16, 2010

Related U.S. Application Data

(60) Provisional application No. 61/186,705, filed on Jun. 12, 2009.

(51) Int. Cl.
*H04R 1/02* (2006.01)

(52) U.S. Cl. ..... 381/386; 381/391; 381/387; 381/388

(58) Field of Classification Search ..... 381/345, 381/386, 387, 388, 389, 391, 392, 395
See application file for complete search history.

(56) References Cited

U.S. PATENT DOCUMENTS

| | | | | |
|---|---|---|---|---|
| 3,720,787 | A * | 3/1973 | Ishii et al. | 381/336 |
| 3,923,124 | A * | 12/1975 | Hancock | 181/156 |
| 5,938,161 | A | 8/1999 | Takeuchi et al. | |
| D526,644 | S * | 8/2006 | Breit | D14/216 |
| 7,463,746 | B2 | 12/2008 | Caron et al. | |
| 7,561,330 | B2 | 7/2009 | Goto | |

FOREIGN PATENT DOCUMENTS

| | | |
|---|---|---|
| JP | 2004-015248 | 1/2004 |

* cited by examiner

*Primary Examiner* — Curtis Kuntz
*Assistant Examiner* — Amir Etesam

(57) ABSTRACT

A speaker assembly mounted on a bracket extending from a ceiling comprises an enclosure that includes a bottom wall, side walls including opposing first and second side walls, a sleeve that receives a tubular member of the bracket, and an interior wall having a first segment that extends from the sleeve to the first side wall and a second segment that extends from the sleeve to the second side wall. The interior wall cooperates with the sleeve to divide the enclosure into two approximately equal sized compartments. Each of the speakers within the assembly either forms, or is mounted in or on, one of the side walls. A top plate is mounted on, and forms a top of, the enclosure and seals the two compartments, the top plate having an opening that is aligned with the sleeve when the top plate is mounted on the enclosure. A power unit and circuitry for the speakers are mounted on the top plate.

8 Claims, 6 Drawing Sheets

SOUND ENHANCEMENT SYSTEM

CROSS REFERENCE TO RELATED APPLICATION(S)

This application is based, and claims priority under 35 U.S.C. §119(e), on provisional application No. 61/186,705, filed Jun. 12, 2009, and entitled "Sound Enhanced System." The content of this provisional application is incorporated by reference herein in its entirety.

BACKGROUND

1. Field of Invention

The present invention is related to a sound enhancement system that includes a speaker assembly, and which may further include a microphone unit, strategically mounted to enhance the sound within the listening environment.

2. Description of Related Art

In many listening environments, particularly classroom or other educational environments, equal sound distribution cannot be achieved simply by the human speaker raising or lowering his or her voice. Some prior solutions to this sound distribution problem involve distributed speaker placement, which entails additional equipment and tends to be suboptimal for effective speech transition. Other approaches tend to result in uneven sound distribution, are expensive and/or are complex to install or set up.

What is lacking, but needed, is a sound system that effectively enhances and distributes sound within the listening environment, is compact and is capable of being mounted with other associated equipment, such as a projector.

SUMMARY OF INVENTION

The present invention addresses this need by providing a speaker assembly configured to be mounted on a bracket extending from a ceiling. The speaker assembly comprises an enclosure that includes a bottom wall, side walls including a first side wall and a second side wall opposing the first, a sleeve configured to receive a tubular member of the bracket, and an interior wall having a first segment that extends from the sleeve to the first side wall and a second segment that extends from the sleeve to the second side wall, the interior wall cooperating with the sleeve to divide the enclosure into two approximately equal sized compartments. The speaker assembly further comprises a plurality of speakers, each of which either partially forms one of the side walls or is mounted in or on one of the side walls; a top plate mounted on, and forming a top of, the enclosure and sealing the two compartments, the top plate having an opening that is aligned with the sleeve when the top plate is mounted on the enclosure; a power unit mounted on the top plate; and circuitry mounted on the top plate and in communication with the speakers.

The circuitry may comprise an amplifier unit and/or a digital signal processing unit.

In some embodiments, the speaker assembly further includes a remote unit to control the speakers and the power unit.

Another aspect of the invention entails a sound system that comprises a speaker assembly as described above, and microphone unit mounted on the top plate. Such system may further include a remote unit to control the speakers, the power unit, and the microphone unit.

Still another aspect of the invention entails a multimedia system that comprises a speaker assembly as described above, and a projector constructed to be mounted on the bracket extending from the ceiling.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The speaker assembly of the present invention enhances sound to increase its intelligibility and distribution within a listening environment. The sound may emanate from a microphone or other source, such as a multimedia file being played on a projector with which the speaker assembly is associated. The speaker assembly of the present invention has particular utility in a classroom or other learning environment where it is very important that those in attendance clearly hear what is being said. To that end, the inventive speaker assembly provides an integrated classroom sound reinforcement system, optimally mounted to enhance speech and other sound transmission and increase the intelligibility of classroom instruction.

The speaker assembly, which in some embodiments is combined with a microphone unit to form a sound system, is preferably mounted using a ceiling hanging bracket on which an associated projector is also mounted. By using such a ceiling hanging bracket, the speaker assembly can be arranged to evenly distribute sound—both in terms of quality and volume—throughout the room or other substantially enclosed environment without additional installation. Moreover, the number and location of other associated components, such as the speakers (e.g., speaker drivers), can be optimized to achieve this advantageous effect. By making a structure, in accordance with embodiments of the invention, that decreases the vibration from the speaker assembly, noise and other unwanted effects on images projected by the projector caused by joint vibration of the speaker assembly, the ceiling hanging bracket, or the projector can be eliminated or at least significantly reduced.

An appropriate equalizing function is provided to both external sound sources and the microphone input (voice sound) by including a DSP unit to attain high quality playback of each sound source. The DSP unit also preferably includes howling prevention functionality, which may be in the form of software, to attain a stable audio environment in which lectures or presentations can be held.

Figure 1:
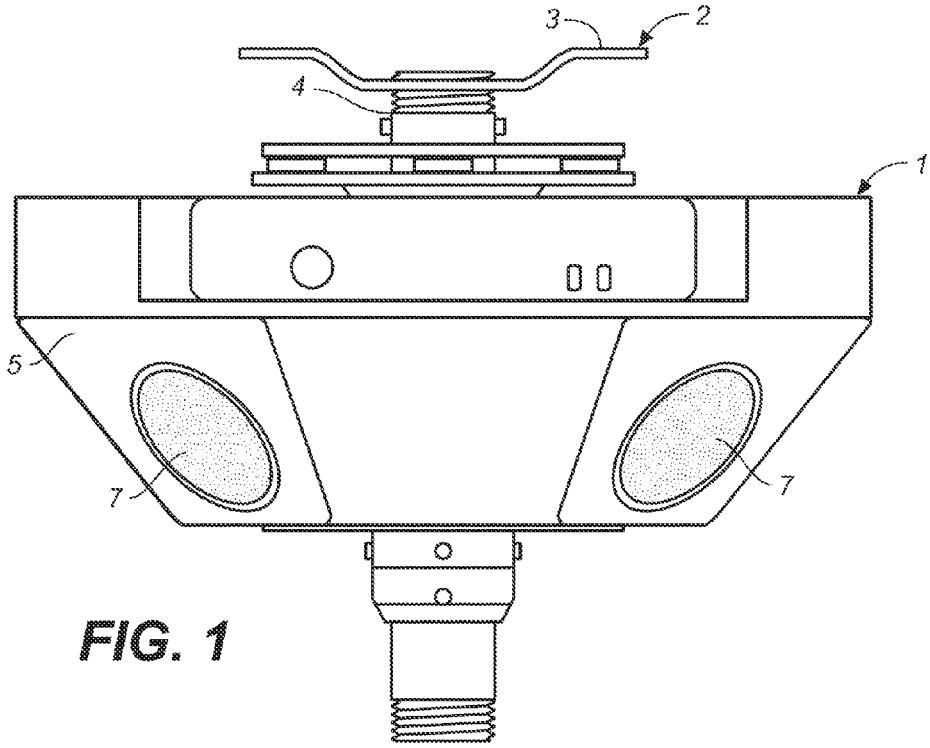
FIG. 1 is a bottom side view of a speaker assembly constructed in accordance with embodiments of the present invention.
Figure 2:
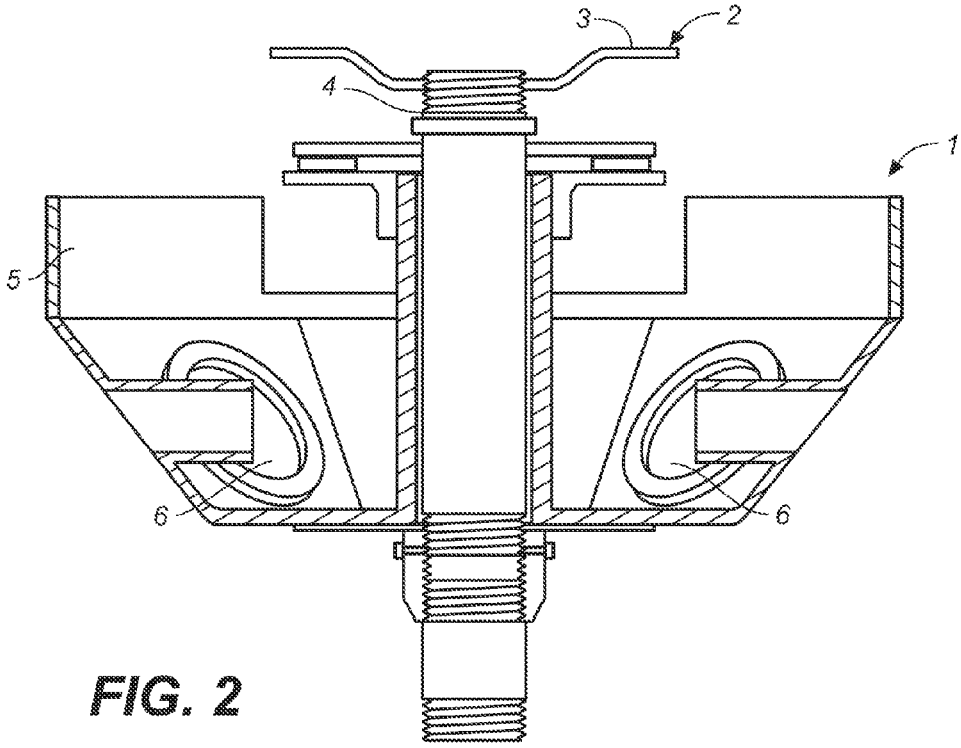
FIG. 2 is a bottom side cross-sectional view of such a speaker assembly.

FIGS. 1 and 2 of the accompanying drawings are lateral and cross-sectional views respectively of a speaker assembly 1, constructed in accordance with embodiments of the invention, mounted on a hanging ceiling bracket 2, which includes a ceiling attachment 3 that supports a tubular structure 4 extending downward from the attachment and ceiling. Speaker assembly 1 includes an enclosure 5, which, in the illustrated embodiment, includes multiple cutouts 6 and a corresponding number of speakers 7, each mounted in a respective one of the cutouts.

Figure 3:
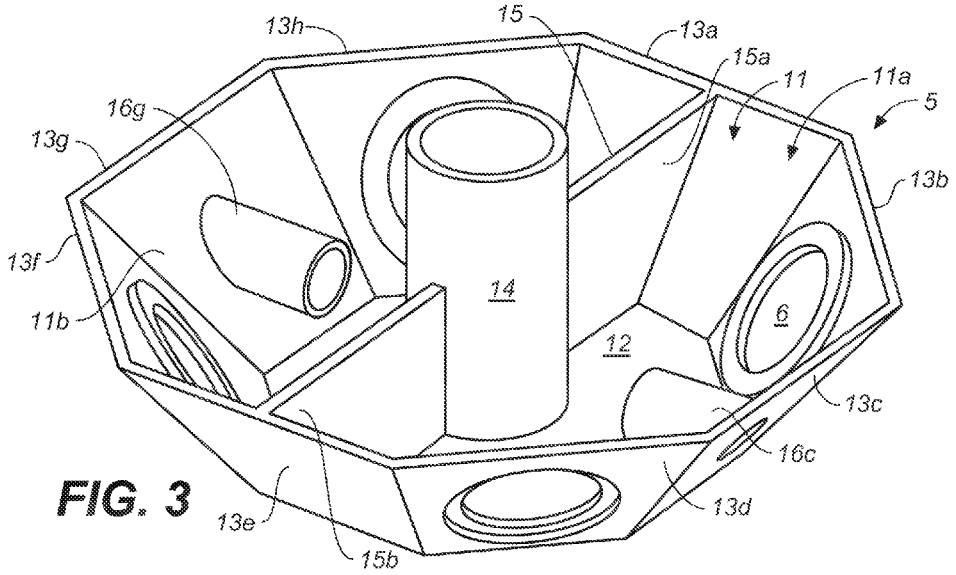
FIG. 3 is a perspective view of an enclosure of such a speaker assembly, showing the interior of the enclosure.

FIG. 3 illustrates enclosure 5 of speaker assembly 1, showing an interior 11 thereof. Enclosure 5 is preferably an integral structure made of a suitable non-metal material. Enclosure 5 includes a bottom wall 12, which in some embodiments, has an octagonal shape, providing eight edges. Enclosure 5 further includes a plurality of side walls (eight in the illustrated embodiment) 13*a*-13*h*, one extending generally upward and slightly outward from a corresponding edge of bottom wall 12. Bottom wall 12 and side walls 13 generally define interior 11.

Bottom wall 12 has an opening from which extends a tubular sleeve 14 for receiving tubular structure 4 of ceiling bracket 2. Sleeve 14 also serves to insulate the components of the speaker assembly from tubular structure 4 (which may be a metal pipe). An interior wall 15, having a first segment 15*a* that extends from tubular sleeve 14 to side wall 13*a* and a second segment 15*b* that extends from tubular sleeve 14 to side wall 13*e*, which opposes side wall 13*a*. Interior wall 15, together with sleeve 14, divide or partition interior 11 into multiple compartments (two of approximately equal size in the illustrated embodiment) 11*a* and 11*b*.

Each of opposing walls 13*c* and 13*g* may also include a cutout from which extends a corresponding tubular sleeve 16*c* and 16*g* respectively. The cutouts in walls 13*c* and 13*g* may be smaller in size than cutouts 6 used to accommodate speakers 7. Cutouts 16*c* and 16*g* enable interior compartments 11*a* and 11*b* respectively to communicate with the external environment.

Figure 4:
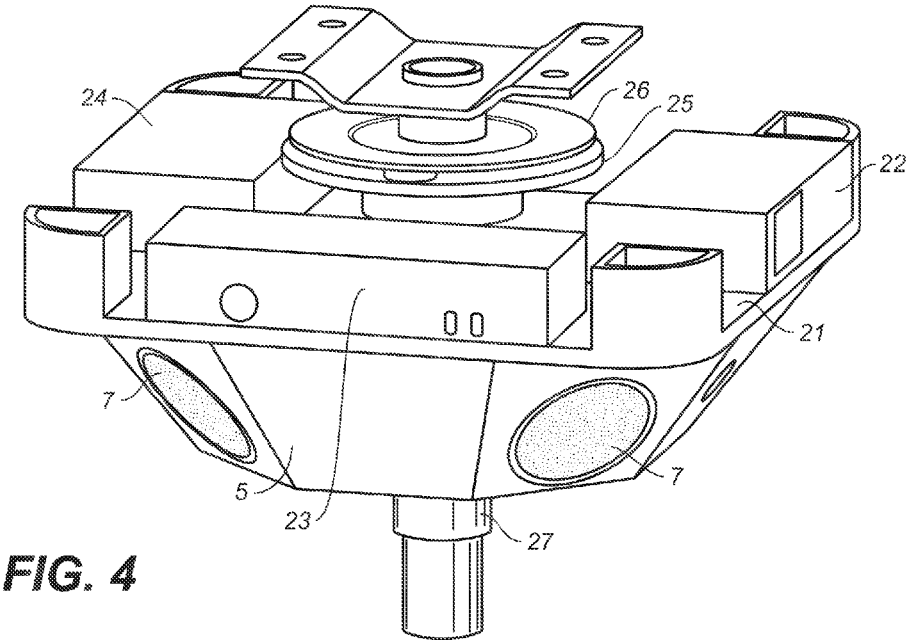
FIG. 4 is a perspective view of such a speaker assembly, showing a top portion thereof.

Referring now to FIG. 4, the lower portion of speaker assembly 1 generally embodies enclosure 5 and speakers 7 mounted thereon. The upper portion of speaker assembly 1 comprises a top plate 21 mounted on and closes the upper, open end of enclosure 5. Top plate 21 also serves to close compartments 11*a* and 11*b*, not only from the exterior, but from each other. By so separating the compartments, sound characteristics can be set individually in each compartment. For example, the bass reflex can be set horizontally or vertically in each of the separated compartments. Top plate 21 has an opening that is aligned with tubular sleeve 14 when the top plate is mounted on enclosure 5 to accommodate tubular structure 4.

Speaker assembly 1 further preferably comprises an electrical power source, e.g., power unit 22, and circuitry, in the form of a unit 23 that includes an amplifier, a digital signal processing component, or both mounted on top plate 21. In embodiments of the invention, a microphone unit 24 is also mounted on top plate 21.

With this construction, speaker assembly 1 can be formed as a single unit that can be slidably mounted on tubular structure 4 (e.g., pipe) of ceiling bracket 2, but not affixed directly to the ceiling. Instead, speaker assembly 1 is held in place above by a flange 25 and accompanying rubber element 26 that fit on the tubular structure. A rubber washer 27 or the like with appropriate support strength mounted on tubular structure 4 supports the speaker assembly below. This mounting configuration reduces vibrations occurring during audio play and removes, as much as possible, unwanted effects that the tubular structure (e.g., pipe) may cause.

Figure 5:
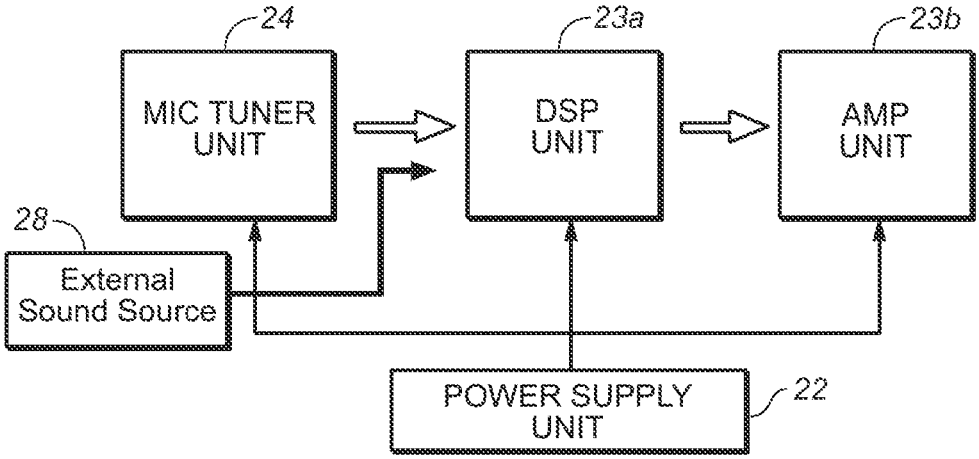
FIG. 5 is a schematic diagram of various electrical components of such a speaker assembly.

FIG. 5 shows a block diagram of components of speaker assembly 1 in accordance with embodiments of the invention. An external sound source 28, which may be sound from an accompanying multimedia presentation, and sound outputted by microphone unit 24 is input to a digital signal processing (DSP) unit 23*a*, where a mixing process is performed. In so doing, DSP unit 23*a*, using its equalizing function, optimizes the sound quality of each sound source. The mixed sound is output to amplifier (AMP) unit 23*b*. Unwanted howling, which may occur because of microphone location or other related condition, can be controlled by adjusting the gain of the amplifier. Microphone unit 24 may also include a tuner.

Control of speaker assembly 1 may be accomplished by a remote control, which advantageously may the same remote used to control an associated projector. This eliminates the need for separate remote control units.

Figure 6:
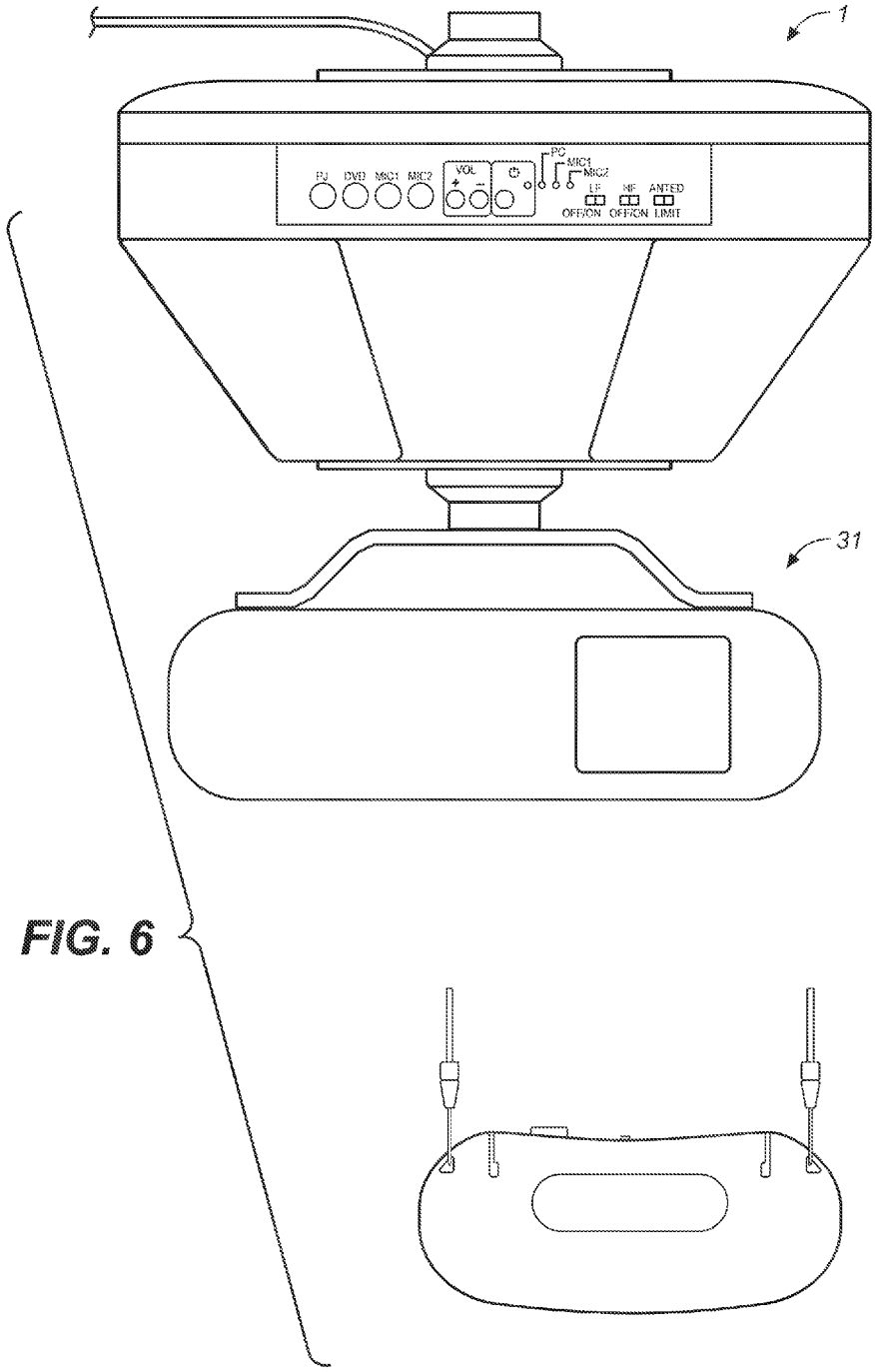
FIG. 6 is a perspective view of a multimedia system comprising a speaker assembly and a projector.
Figure 7A:
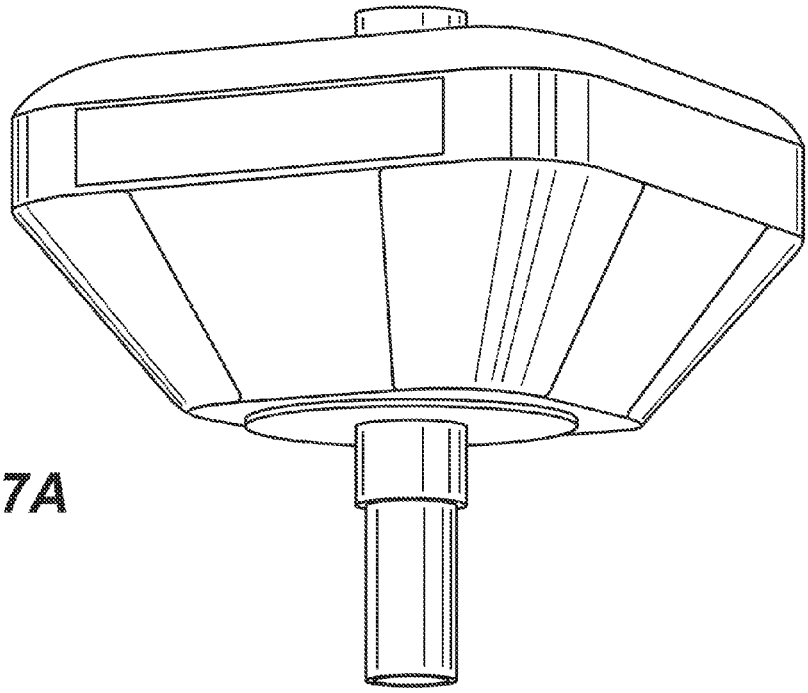
FIGS. 7A-E is a series of illustrations of a speaker system constructed in accordance with embodiments of the invention.
Figure 7B:
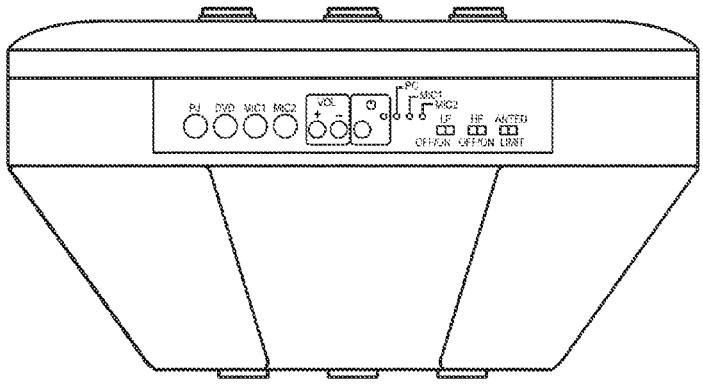
Figure 7C:
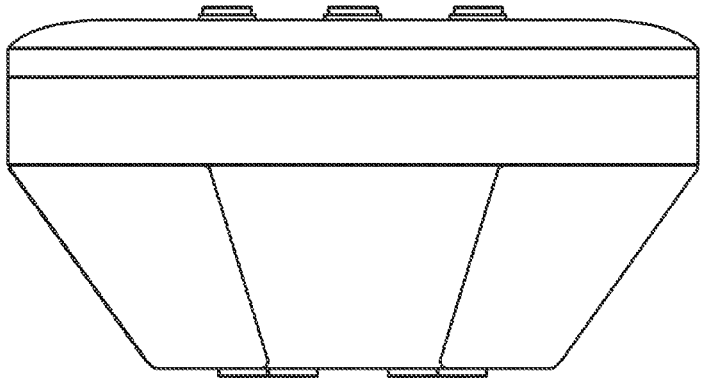
Figure 7D:
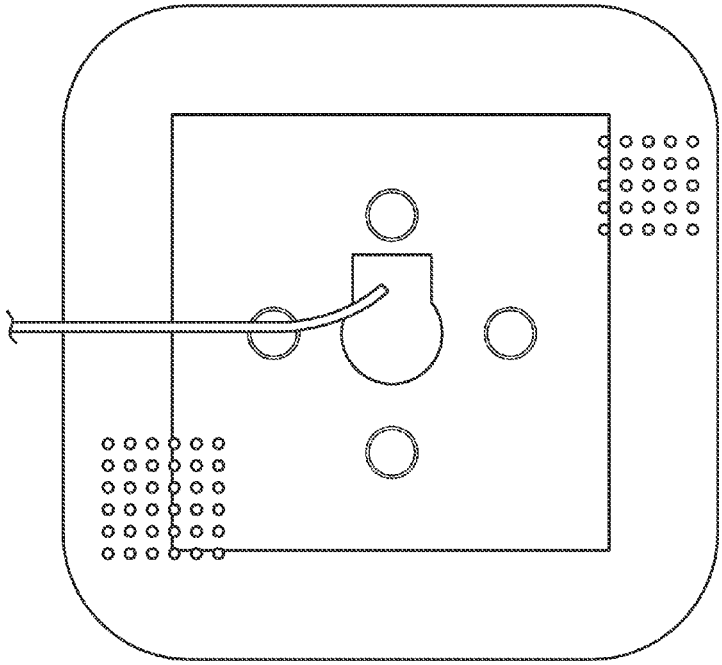
Figure 7E:
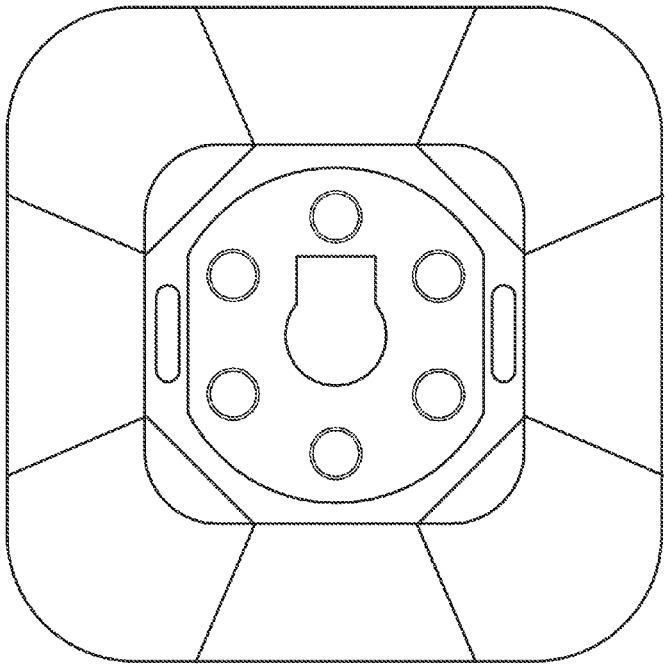

FIG. 6 shows a preferred embodiment of speaker assembly 1, one in which the speaker assembly is mounted with a projector system 31. Such a speaker assembly 1 may include a 30 W×2-channel amplifier, a DSP unit that includes vocal-tailored equalization, 4 wide-dispersion speaker drivers, a pendant microphone for the instructor or lead presenter, remote control for the speaker assembly and which also controls key projector functions, and a mounting bracket and necessary cables. One benefit of such a system is that it is completely integrated. Another benefit is its easy installation; the speaker assembly can be easily mounted onto a standard projector mount; no additional drilling, cutting or hardware is needed. The system is also suitable for retro-fit installation. Functionally, the speaker assembly advantageously delivers 360° of sound and is optimized for voice in that it enhances clarity and intelligibility. Moreover, the speaker assembly is able to amplify one or more audio sources.

FIGS. 7A-E provides a series of illustrations, showing different views of an integrated speaker assembly according to another of the invention.

The speaker assembly according to embodiments of the present invention provides a high quality sound without high cost. Moreover, by internalizing all speaker functions and components in one unit, the speaker assembly is easy to handle and relatively inexpensive to install. Use of a hanging ceiling bracket which is used to mount an associated projector to also mount the speaker assembly essentially eliminates any additional installation and set up costs. Audio performance is also improved relative to ceiling installed speakers.

As the foregoing demonstrates, the speaker assembly of the present invention, which may further include other functionality such as a microphone unit, provides a high quality, low cost solution to audio needs in connection with lectures, speeches, presentations, etc., particularly in a learning environment. Additional advantages are attained by using the speaker assembly with an associated projector.

While the invention has been described in conjunction with several specific embodiments, further alternatives, modifications and variations will be apparent to those skilled in the art in light of the foregoing description. Thus, the invention described herein is intended to embrace all such alternatives, modifications, and variations as may fall within the spirit and scope of the appended claims.

What is claimed is:

1. A speaker assembly configured to be mounted on a bracket extending from a ceiling, the speaker assembly comprising:

an enclosure including a bottom wall, a plurality of side walls including a first side wall, a second side wall opposing the first side wall and at least four other side walls, each of the plurality of side walls extending generally upwardly from the bottom wall, a sleeve configured to receive a tubular member of the bracket, the sleeve having first and second ends with first and second openings respectively, and an interior wall having a first segment that extends from the sleeve to the first side wall and a second segment that extends from the sleeve to the second side wall, the interior wall cooperating with the sleeve to divide the enclosure into two approximately equal sized compartments;

a plurality of speakers, each of which either partially forms one of the at least four other side walls or is mounted in or on one of the at least four other side walls, wherein no speaker partially forms or is mounted in or on either of the first side wall or the second side wall;

a top plate mounted on, and forming a top of, the enclosure and sealing the two compartments, the top plate having an opening that is aligned with the sleeve when the top plate is mounted on the enclosure;

a power unit mounted on the top plate; and circuitry mounted on the top plate and in communication with the plurality of speakers.

2. The speaker assembly of claim 1, wherein the circuitry comprises an amplifier unit.

3. The speaker assembly of claim 1, wherein the circuitry comprises a digital signal processing unit.

4. A sound system, comprising:

the speaker assembly of claim 1; and a microphone unit mounted on the top plate.

5. A system, comprising:

the speaker assembly of claim 1; and a projector constructed to be mounted on the bracket extending from the ceiling.

6. The speaker assembly of claim 1, wherein each of the plurality of side walls is substantially planar.

7. The speaker assembly of claim 1, wherein the top plate is substantially planar.

8. The speaker assembly of claim 1, wherein the plurality of side walls further includes two additional side walls, each of the two additional side walls including a passage that enables the compartments to communicate with the exterior environment, wherein no speaker partially forms or is mounted in or on either of the two additional side walls.

* * * * *